US005163482A

United States Patent [19]

Wolcott

[11] Patent Number: 5,163,482

[45] Date of Patent: Nov. 17, 1992

[54] TOOL FOR APPLYING CLAMPING BANDS

[75] Inventor: Wayne B. Wolcott, Dayton, Ohio

[73] Assignee: Electro Adapter, Inc., Chatsworth, Calif.

[21] Appl. No.: 767,140

[22] Filed: Sep. 27, 1991

[51] Int. Cl.[5] ..... B21F 9/02

[52] U.S. Cl. ..... 140/123.6; 140/93.4

[58] Field of Search ..... 140/93 A, 93.2, 93.4, 140/123.5, 123.6

[56] References Cited

U.S. PATENT DOCUMENTS

| | | | |
|---|---|---|---|
| 1,900,238 | 3/1933 | Harvey | 140/93.2 |
| 1,989,669 | 2/1935 | Harvey | 140/123.6 |
| 2,007,002 | 7/1935 | Porter | 140/93.4 |
| 2,175,478 | 10/1939 | McKee . | |
| 3,433,275 | 3/1969 | Eppler . | |
| 3,648,739 | 3/1972 | Angarola . | |
| 3,661,187 | 5/1972 | Caveney et al. . | |
| 3,712,346 | 1/1973 | Noorily . | |
| 3,752,199 | 8/1973 | Fekete . | |
| 3,782,426 | 1/1974 | Morgan et al. . | |
| 3,853,155 | 12/1974 | Kabel . | |
| 4,047,545 | 9/1977 | Paradis . | |
| 4,688,607 | 8/1987 | Wolcott . | |
| 4,726,403 | 2/1988 | Young et al. . | |
| 4,934,416 | 6/1990 | Tonkiss . | |

*Primary Examiner*—Lowell A. Larson

*Attorney, Agent, or Firm*—Harris, Kern, Wallen & Tinsley

[57] ABSTRACT

An apparatus for tightening and securing banding material about an article within predetermined tension limits, including a housing for receiving and guiding the banding material, a drive for incrementally advancing the banding material about the article, a first gripper for securing the banding material as it is being incrementally advanced, a slip clutch for precisely determining when the predetermined tension of the banding material about the article is reached, a second gripper for locking and maintaining the banding material about the article, a drive motor, and a ratchet mechanism driven from the drive motor through the slip clutch for reciprocating the first gripper.

15 Claims, 4 Drawing Sheets

FIG. 1
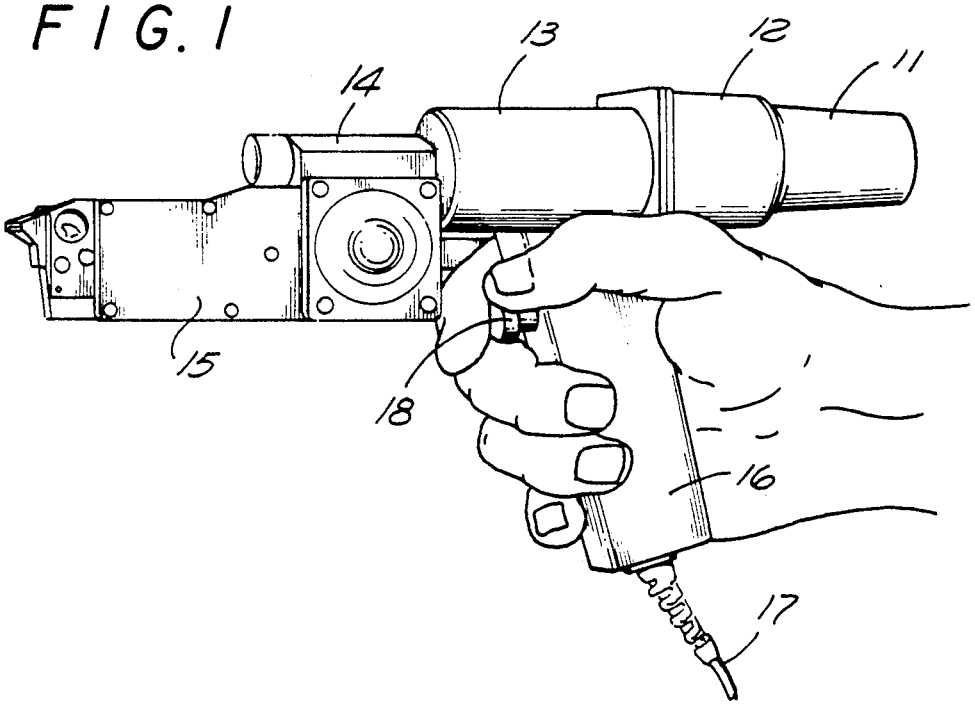
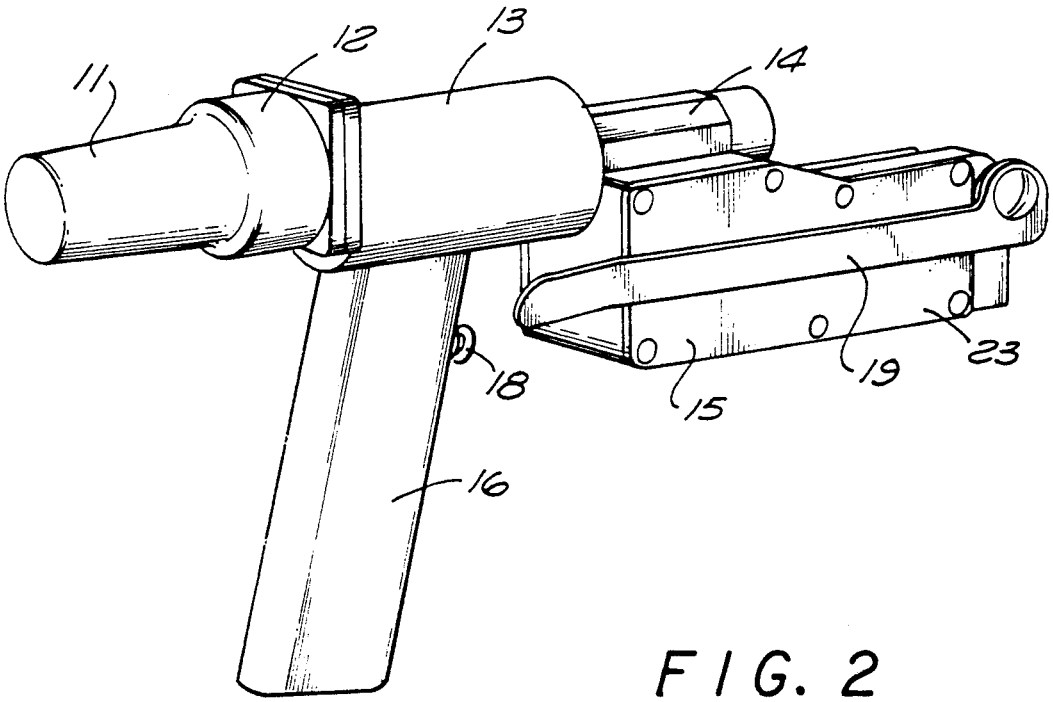
FIG. 2

TOOL FOR APPLYING CLAMPING BANDS

BACKGROUND OF THE INVENTION

The present invention relates to a banding tool for banding an article with a predetermined band pressure or tension in the band and then automatically locking that band tension about the article.

Banding tools of this nature are shown in U.S. Pat. Nos. 4,688,607 and 4,726,403. The tools of these prior patents operate satisfactorily in many instances with a reciprocating action for applying tension to the band during a pulling stroke and locking the band in place to maintain the tension during the return stroke. However the tools are manually operated and are difficult to utilize in some applications where access to the article being banded is limited.

It is an object of the present invention to provide a new and improved banding tool which overcomes the disadvantages of the prior designs and which is power driven, as from an electrical or pneumatic pressure source, requiring only a finger actuated trigger or switch for control of the tool.

In applying the bands, it is desirable to achieve a predetermined tension in the band automatically so that the operator does not have to be concerned with measuring and/or controlling band tension. In the past, this has been achieved by use of a group of links forming an over-center mechanism and by a stack of springs or over-center washers. These constructions have proved difficult to manufacture and maintain, and it is another object of the present invention to provide a new and improved system for operation at the predetermined band tension.

Other objects, advantages, features and results will more fully appear in the course of the following description.

SUMMARY OF THE INVENTION

An apparatus for tightening and securing banding material about an article within predetermined tension limits, and including means for receiving and guiding the banding material, means operatively connected to the receiving and guiding means for incrementally advancing the banding material about the article, means operatively connected to the advancing means for precisely determining when the predetermined tension of the banding material about the article is reached, means operatively connected to the receiving and guiding means for locking and maintaining the banding material about said article. The advancing means includes a drive motor, a slip clutch, and a ratchet mechanism, with the ratchet mechanism driven from the drive motor through the slip clutch for reciprocating the advancing means. The slip clutch is adjustable to slip at a predetermined value corresponding to the predetermined band tension. The ratchet mechanism preferably includes a gear driven in rotation from the drive motor and having a plurality of circularly disposed pawl engaging members, a pawl having tooth means for engaging the pawl engaging members, first spring means for urging the pawl away from the gear, and second spring means for urging the pawl tooth means into engagement with the gear pawl engaging members as the gear rotates to reciprocate the pawl. The pawl tooth means preferably include first and second steps with the first step engaging a pawl engaging member as the gear rotates until the second step engages a following pawl engaging member moving the first step away from the gear and permitting the pawl to engage the first step with the following pawl engaging member.

BRIEF DESCRIPTION OF THE DRAWINGS

FIG. 1 is a perspective view of a banding tool incorporating the presently preferred embodiment of the invention, taken from the left side of the tool;

FIG. 2 is a view similar to that of FIG. 1 taken from the right side of the tool;

DESCRIPTION OF THE PREFERRED EMBODIMENT

Figure 3:
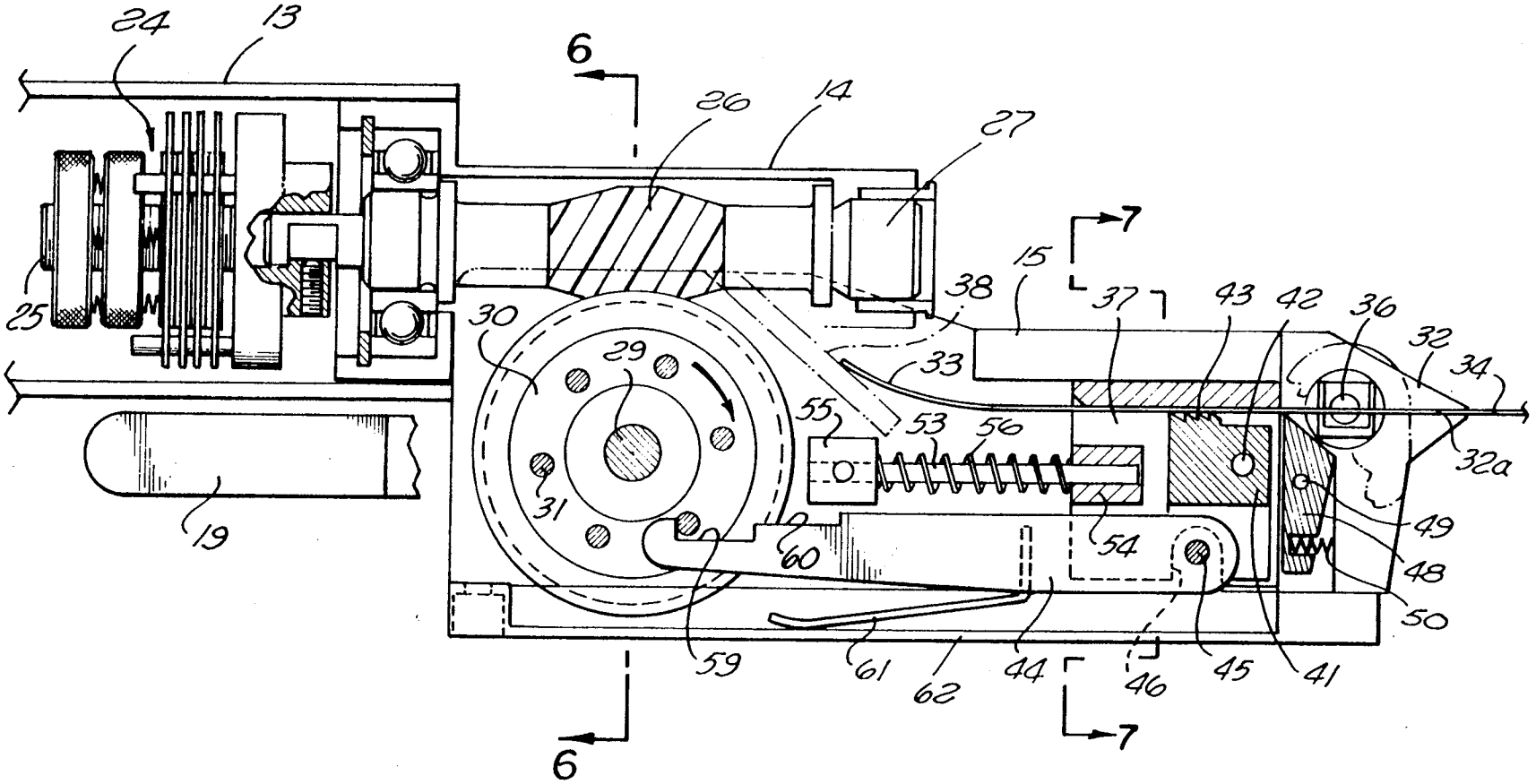
FIG. 3 is an enlarged partial vertical sectional view of the tool of FIG. 2 showing the pulling mechanism in the rest position.

The overall banding tool is shown in FIGS. 1 and 2 and includes a drive motor 11 with gear reduction unit 12, an clutch housing 13, a worm and gear drive unit 14, a main housing 15 and a handle 16. Preferably the drive motor is an electric motor powered from an electric line 17 running up through the handle and controlled by a switch 18. Other forms of drive motors can be used, such as pneumatic pressure motors.

A cut-off lever 19 is positioned on the exterior of the main housing 15, pivoted at the front end of the tool for rotating a conventional band cut-off blade.

Figure 5:
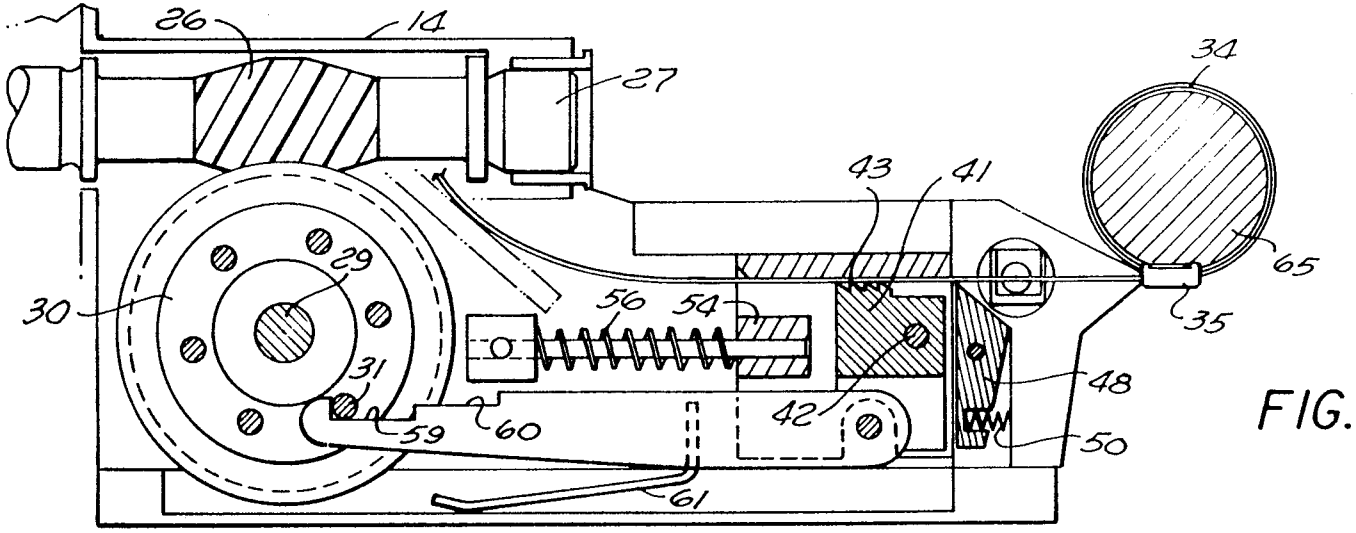
FIG. 5 is a view similar to that of FIG. 4 showing the tool in the locking position just prior to initiating another pulling stroke.
Figure 6:
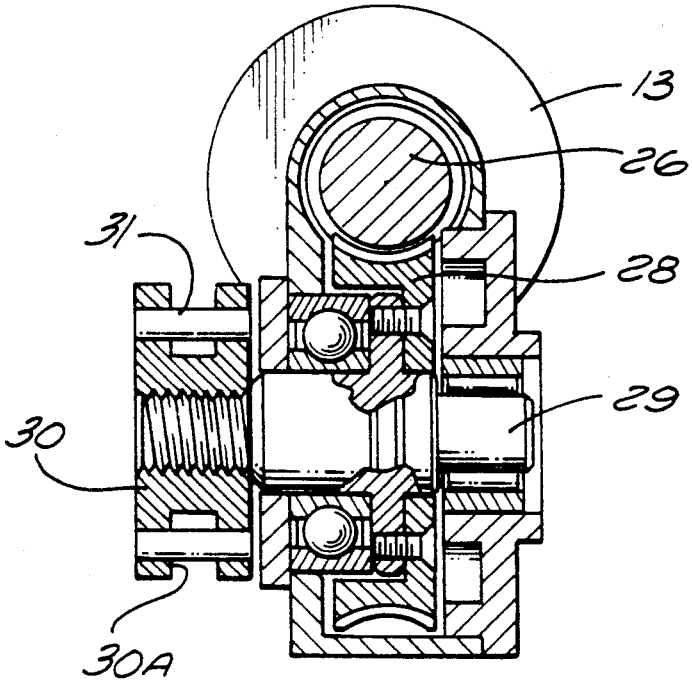
FIG. 6 is a sectional view taken along the line 6—6 of FIG. 3.
Figure 7:
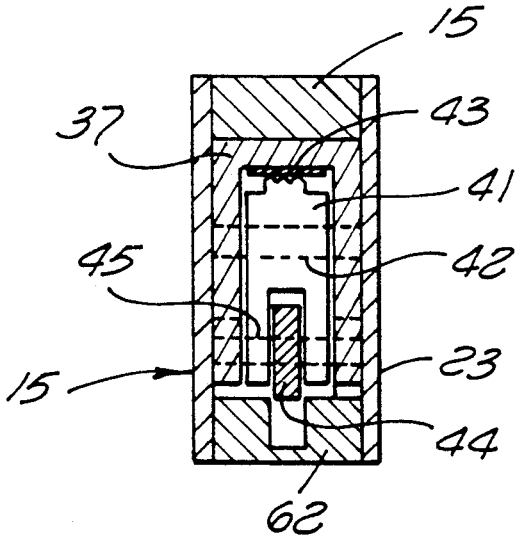
FIG. 7 is a sectional view taken along the line 7—7 of FIG. 3.

The interior of the tool is shown in FIG. 3 with the cover 23 of the main housing 15 removed. A slip clutch 24 is positioned in the clutch housing 13 with the drive motor gear reduction unit connected at the left end 25 of the clutch 24. A worm 26 is carried on a shaft 27 mounted in bearings in the housing, and drives a gear 28 (FIG. 6), with the worm carried on a shaft 29 for rotation of a wheel 30 mounted on the shaft. In the preferred embodiment illustrated, an annular groove 30A is formed in the wheel 30, with a plurality of pins 31 positioned across the groove, as best seen in FIG. 6. With this arrangement, the drive motor when energized, continuously rotates the wheel 30 in the clockwise direction as viewed in FIGS. 3–5.

The clutch 24 is a slip clutch, that is, the torque provided at the output of the clutch is the same as the torque at the input to the clutch until a predetermined torque is reached. Then the clutch slips, no longer providing an output torque corresponding to the input torque as the input torque increases above the preset torque limit. The slip clutch is adjustable so that the tool can be calibrated to provide a pulling force and thereby a tension in the band at a predetermined value as required for the application. Thus after the slip clutch has once been adjusted in a calibration tool to provide the desired maximum band tension, the operator can utilize the tool in banding operations without being concerned with determination of band tension.

The slip clutch utilized in the illustrated embodiment is a Polyclutch Slipper model from Custom Products Corp. The torque at which the clutch will slip can be set at the time of manufacture of the clutch or can be set after the clutch is installed in the banding tool, as desired.

A nose 32 at the forward end of the housing 15 is provided with a slot 32A for receiving the free end 33 of a band 34. The band is a conventional product and has a buckle 35 at the opposite end.

The free end of the band is fed through the slot 32, a conventional cut-off blade 36, and a shuttle 37 and is deflected upward for exiting through the top of the housing by a deflector 38.

A first gripping member 41 is mounted in the shuttle 37 on a pivot pin 42. Preferably one or more gripper teeth 43 are provided at the upper side of the gripping member 41. The first gripping member 41 is also connected to a pawl 44 by another pivot pin 45. The pin 45 passes through a clearance opening 46 in the lower portion of the shuttle.

A second gripping member or restrictor 48 is mounted in the housing on a pivot pin 49, with a spring 50 between the member and the housing, urging the member in the clockwise position as viewed in FIG. 3. The second gripping member also preferably has at least one tooth at the upper surface.

A shaft 53 is mounted in a block 54 in the shuttle, and slides in another block 55 in the housing, with a spring 56 around the shaft. The spring 56 is a compression spring which urges the shuttle to the right as viewed in FIG. 3.

The pawl 44 has a first step 59 and a second step 60 at the rear end, with a spring member 61 between the pawl and the bottom 62 of the housing urging the rear end of the pawl upward toward the pins 31 of the wheel 30.

Figure 4:
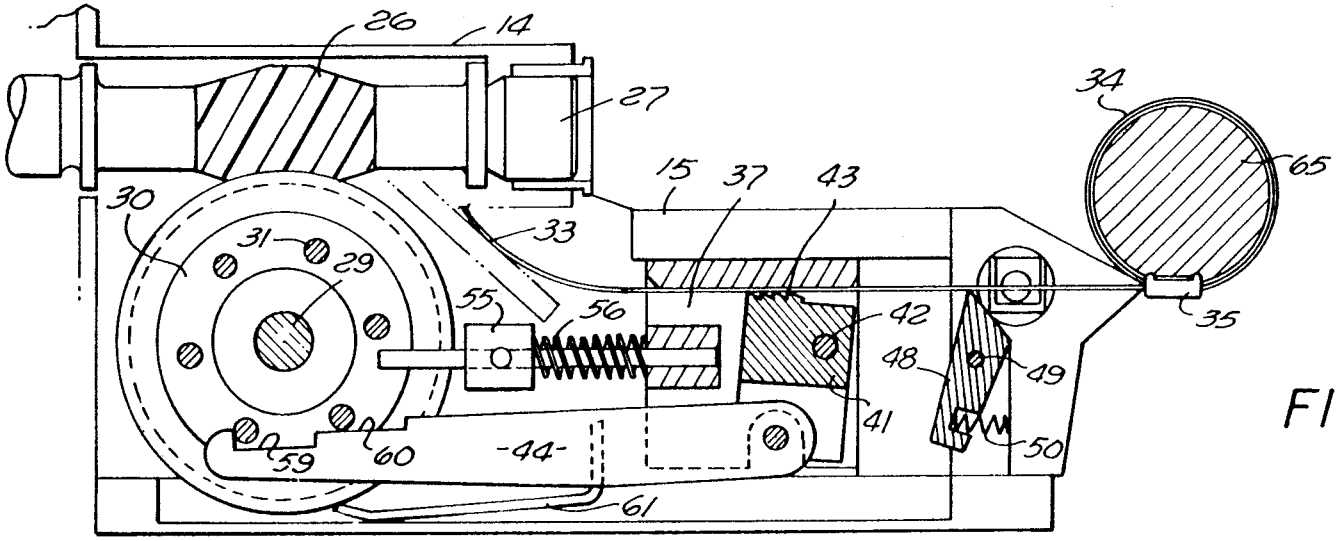
FIG. 4 is an enlarged sectional view of a portion of FIG. 3 showing the tool near the end of the pulling stroke.

In operation, a band 34 is wrapped around an article to be banded 65, with the free end 33 of the band passed through the buckle 35 of the band. Typically two wraps of the band about the article are utilized, as shown in FIGS. 4 and 5. The free end of the band is fed through the housing to about the position of FIG. 3. The switch 18 is actuated and the drive motor rotates the wheel 30 clockwise as shown in FIGS. 3–5.

The wheel 30 with the pins 31 and the pawl 44 with the steps 59, 60 function as a ratchet mechanism which provides a reciprocating motion of the shuttle within the housing. Initially the first step 59 of the pawl engages a pin, as shown in FIG. 3. Rotation of the wheel pulls the pawl to the left as shown in FIG. 4, rotating the first gripper member 41 clockwise to engage its teeth with the band and moving the shuttle to the left to the position shown in FIG. 4 and applying tension to the band pulling the band to the left.

The next pin of the wheel now engages the second step 60 of the pawl, moving the pawl downward and freeing the pawl from the preceding pin. When the first step of the pawl is released from the preceding pin, the spring 56 moves the shuttle and pawl to the right, to the position of FIG. 5, and the spring 61 moves the first step 59 of the pawl into engagement with the following pin.

As the shuttle moves to the left during the pulling stroke, the second gripping member 48 pivots from the position of FIG. 3 to the position of FIG. 4. When the shuttle starts the return stroke, moving to the right when the first step of the pawl releases from the pin, the first gripping member 41 pivots counterclockwise from the position of FIG. 4 to the position of FIG. 5. At this time, the second gripping member 48 locks the band in position in the housing so that there is no relaxing of tension in the band during the return stroke of the shuttle from the position of FIG. 4 to the position of FIG. 5.

The reciprocating motion of the shuttle is repeated until the predetermined tension in the band around the article being banded is reached. When this occurs, the clutch slips so that there is no further application of pulling tension. The operator observes the slipping and releases the switch shutting off the drive motor. The banding operation is completed in the conventional manner by rotating the tool relative to the article being banded to fold the band back over the buckle and then the cut-off lever 90 is moved downward relative to the tool to rotate the cut-off plate 36 and sever the band.

I claim:

1. An apparatus for tightening and securing banding material about an article within predetermined tension limits, said apparatus including:

means for receiving and guiding said banding material;

means operatively connected to said receiving and guiding means for incrementally advancing said banding material about said article;

means operatively connected to said advancing means for precisely determining when said predetermined tension of said banding material about said article is reached; and means operatively connected to said receiving and guiding means for locking and maintaining said banding material about said article;

the improvement wherein said advancing means includes:

a drive motor;

a slip clutch; and a ratchet mechanism;

with said ratchet mechanism driven from said drive motor through said slip clutch for reciprocating said advancing means.

2. An apparatus as defined in claim 1 wherein said slip clutch is adjustable to slip at a predetermined value corresponding to said predetermined band tension.

3. An apparatus as defined in claim 2 wherein said ratchet mechanism includes:

a gear driven in rotation from said drive motor and having a plurality of circularly disposed pawl engaging members;

a pawl having tooth means for engaging said pawl engaging members;

first spring means for urging said pawl away from said gear; and second spring means for urging said pawl tooth means into engagement with said gear pawl engaging members as said gear rotates to reciprocate said pawl.

4. An apparatus as defined in claim 3 wherein said pawl tooth means include first and second steps with said first step engaging a pawl engaging member as said gear rotates until said second step engages a following pawl engaging member moving said first step away from said gear and permitting said pawl to engage said first step with said following pawl engaging member.

5. An apparatus as defined in claim 4 wherein said advancing means includes:

a shuttle reciprocated by said pawl; and a first member pivotally mounted in said shuttle for gripping said band as said pawl and shuttle are pulled by said gear to apply tension to said band; and with said means for locking including a second member pivotally mounted for gripping said band as said pawl and shuttle are released from said gear.

6. A tool for tightening a band to a predetermined tension about an article by pulling said band through a buckle thereon, including in combination:

means defining a housing having a nose at the front end thereof provided with a slot for admitting the end of a band to the interior of said housing;

reciprocable feeding means within said housing for gripping, incrementally pulling said band into said housing, and then releasing said band; and means within said housing for gripping said band in response to release of said band by said feeding means;

said feeding means including:

an element supported for reciprocating movement in said housing;

a drive motor;

a drive mechanism for converting rotating motion of said motor to reciprocating motion for said element; and means controlled by the tension in said band for maintaining an operative connection between said drive motor and said element and for releasing said operative connection in response to a predetermined tension in said band.

7. A tool as defined in claim 6 wherein said controlled tension means includes an adjustable slip clutch.

8. A tool as defined in claim 7 wherein said drive mechanism includes a ratchet mechanism having a gear driven in rotation from said drive motor and having a plurality of circularly disposed pawl engaging members, a pawl having tooth means for engaging said pawl engaging members, first spring means for urging said pawl away from said gear, and second spring means for urging said pawl tooth means into engagement with said gear pawl engaging members as said gear rotates to reciprocate said pawl.

9. An apparatus as defined in claim 8 wherein said pawl tooth means include first and second steps with said first step engaging a pawl engaging member as said gear rotates until said second step engages a following pawl engaging member moving said first step away from said gear and permitting said pawl to engage said first step with said following pawl engaging member.

10. An apparatus as defined in claim 8 wherein said feeding means further includes:

a shuttle reciprocated by said pawl; and a first member pivotally mounted in said shuttle for gripping said band as said pawl and shuttle are pulled by said gear to apply tension to said band; and with said means for locking including a second member pivotally mounted for gripping said band as said pawl and shuttle are released from said gear.

11. An apparatus for tightening and securing banding material about an article within predetermined tension limits, said apparatus having a longitudinal axis and said banding material including a strap with a buckle at one end of the strap and with the strap positioned around the article and passing through the buckle leaving the other end of the strap free, said apparatus including:

means for receiving and guiding said free end of said banding material along said axis with said means for receiving and guiding engaging said buckle;

means for incrementally advancing said banding material about said article, said advancing means including means for securing said banding material within said apparatus as said banding material is being incremetally advanced, and means for precisely determining when said predetermined tension of said banding material about said article is reached; and means operatively connected to said receiving and sending means for automatically locking and maintaining said banding material about said article;

with said apparatus positioned away from said article and engaging said banding material only at said buckle and free end leaving said banding material in direct contact with said article about the entire periphery of said article, and with said means for precisely determining said predetermined thesion of said banding material about said article further comprising:

an element supported for reciprocating movement in said housing;

a drive motor;

a drive mechanism for converting rotating motion of said motor to reciprocating motion for said element; and means controlled by the tension in said band for maintaining an operative connection between said drive motor and said element and for releasing said operative connection in response to a predetermined tension in said band.

12. A tool as defined in claim 11 wherein said controlled tension means includes an adjustable slip clutch.

13. A tool as defined in claim 12 wherein said drive mechanism includes a ratchet mechanism having a gear driven in rotation from said drive motor and having a plurality of circularly disposed pawl engaging members, a pawl having tooth means for engaging said pawl engaging members, first spring means for urging said pawl away from said gear, and second spring means for urging said pawl tooth means into engagement with said gear pawl engaging members as said gear rotates to reciprocate said pawl.

14. An apparatus as defined in claim 13 wherein said pawl tooth means include first and second steps with said first step engaging a pawl engaging member as said gear rotates until said second step engages a following pawl engaging member moving said first step away from said gear and permitting said pawl to engage said first step with said following pawl engaging member.

15. An apparatus as defined in claim 13 wherein said feeding means further includes:

a shuttle reciprocated by said pawl; and a first member pivotally mounted in said shuttle for gripping said band as said pawl and shuttle are pulled by said gear to apply tension to said band; and with said means for locking including a second member pivotally mounted for gripping said band as said pawl and shuttle are released from said gear.

* * * * *